US005515906A

United States Patent [19]

Thomson et al.

[11] Patent Number: 5,515,906

[45] Date of Patent: *May 14, 1996

[54] PNEUMATIC FLOW CONTROL OF LIQUID METALS

[75] Inventors: Robert Thomson, Ontario; Elhachmi Es-Sadiqi, Quebec; James Barry, Ontario, all of Canada

[73] Assignee: Her Majesty in Right of Canada as represented by the Minister of Energy, Mines and Resources, Canada

[ * ] Notice: The term of this patent shall not extend beyond the expiration date of Pat. No. 5,381,854.

[21] Appl. No.: 331,104

[22] Filed: Oct. 28, 1994

Related U.S. Application Data

[63] Continuation-in-part of Ser. No. 36,283, Mar. 24, 1993, Pat. No. 5,381,854.

[30] Foreign Application Priority Data

Jan. 29, 1993 [CA] Canada ..... 2088401

[51] Int. Cl.[6] ..... B22D 11/18; B22D 11/06

[52] U.S. Cl. ..... 164/453; 164/155.3

[58] Field of Search ..... 164/453, 462, 164/463, 423, 155.3

[56] References Cited

U.S. PATENT DOCUMENTS

| | | | |
|---|---|---|---|
| 2,825,104 | 3/1958 | Jones | 164/453 |
| 2,907,082 | 10/1959 | Pond | 164/462 |
| 3,384,150 | 5/1968 | Newsome | 164/155 |
| 4,339,508 | 7/1982 | Tsuya | 164/437 |
| 4,392,523 | 7/1983 | Beller et al. | 164/453 |
| 4,441,541 | 4/1984 | Block | 164/453 |
| 4,449,568 | 5/1984 | Narasimham | 164/463 |
| 4,471,831 | 9/1984 | Ray | 164/437 |
| 4,592,411 | 6/1986 | Bedell | 164/479 |
| 4,600,047 | 7/1986 | Matoba et al. | 164/453 |
| 4,625,787 | 12/1986 | Haveman et al. | 164/453 |
| 4,725,962 | 2/1988 | Hsu et al. | 164/463 |
| 4,774,997 | 10/1988 | Eibe | 164/449 |
| 5,144,999 | 9/1992 | Makino et al. | 164/423 |
| 5,381,854 | 1/1995 | Thomson et al. | 164/453 |

FOREIGN PATENT DOCUMENTS

| | | | |
|---|---|---|---|
| 810587 | 4/1969 | Canada . | |
| 814336 | 6/1969 | Canada . | |
| 906182 | 8/1972 | Canada . | |
| 915382 | 11/1972 | Canada . | |
| 914879 | 11/1972 | Canada . | |
| 1040832 | 10/1978 | Canada . | |
| 58-125361 | 7/1983 | Japan | 164/155.3 |
| 59-66962 | 4/1984 | Japan | 164/453 |
| 60-199551 | 10/1985 | Japan | 164/463 |
| 63-242446 | 10/1988 | Japan | 164/453 |
| 4-258365 | 9/1992 | Japan | 164/479 |
| 9013377 | 11/1990 | WIPO | 164/479 |

*Primary Examiner*—Richard K. Seidel
*Assistant Examiner*—I.-H. Lin
*Attorney, Agent, or Firm*—Jacobson, Price, Holman & Stern

[57] ABSTRACT

A method and apparatus are disclosed for pneumatically controlling the velocity of flow of liquid metal from a tundish into a continuous casting machine through a nozzle. A chamber encloses the nozzle outlet, and at least a portion of the continuous casting machine, and a pressurized gas is supplied to the chamber. The flow velocity of the liquid metal at the nozzle outlet is controlled by controlling the gas pressure in the chamber in response to the level of the liquid metal in the tundish, and the measured atmospheric pressure acting on the liquid metal in the tundish.

4 Claims, 4 Drawing Sheets

| Liquid Metal | Circular Outlet Maximum Diameter (mm) | Rectangular Outlet Maximum Height (mm) |
|---|---|---|
| Hg | 5.4 | 3.8 |
| Pb | 5.8 | 4.0 |
| Sn | 8.0 | 5.6 |
| Zn | 10.0 | 7.0 |
| Cu | 11.4 | 8.0 |
| Ni | 13.6 | 9.6 |
| Fe | 14.8 | 10.5 |
| Mg | 16.9 | 12.0 |
| Al | 17.6 | 12.5 |
| Ti | 18.0 | 12.8 |

FIGURE 5

PNEUMATIC FLOW CONTROL OF LIQUID METALS

This is a continuation in part of U.S. patent application Ser. No. 08/036,283, filed on Mar. 24, 1993 now U.S. Pat. No. 5,381,854 issued Jan. 17, 1995.

FIELD OF THE INVENTION

The present invention relates in general to a method and apparatus for controlling the flow rate of liquid metal, and in particular to a method and apparatus for pneumatically controlling the flow of liquid metal from a tundish of a continuous casting machine, in which the dimensions of the nozzle outlet are substantially the same as those of the solidified cast metal product.

BACKGROUND TO THE PRESENT INVENTION

Continuous casting systems are well known in the prior art. In general, liquid metal flows from a reservoir or tundish, through a nozzle and into a continuous casting machine. Various casting machines are known, including twin roller, twin belt, and one belt systems, in which the liquid metal is delivered between the rollers (or belts) and cools and solidifies therein. There is also known single roller strip-casting systems, in which the liquid metal is supplied to the surface of the roller, and cools and solidifies thereon.

In all of the known continuous casting machines, variations in the flow rate of the liquid metal can have a large (and usually detrimental) effect on the quality of the cast metal product. It is therefore important that the rate at which liquid metal is delivered through the nozzle to the casting machine is carefully controlled to be as constant as possible.

Various means have been proposed for ensuring that liquid metal can be delivered to the casting machine at a highly controlled, and substantially constant rate.

For example, U.S. Pat. No. 3,384,150 (Ewsome) discloses a system in which a reservoir of molten metal is located within a pressure vessel. The reservoir is connected to a tundish so that molten metal can be forced, by means of gas pressure within the pressure vessel, from the reservoir to the tundish. In addition, the tundish is enclosed so that gas pressure can be applied to the liquid metal within the tundish. In operation, a quantity of molten metal is supplied to the reservoir, and the pressure vessel is then sealed. At this point, pressurised gas is supplied to the pressure vessel to force the molten metal into the tundish. A further supply of pressurised gas is provided to the tundish, to force the molten metal from the tundish and into a mold or casting machine. The gas pressure in the tundish is controlled to maintain a constant flow rate into the mold, while the pressure in the pressure vessel is varied to maintain a constant level of molten metal in the tundish.

U.S. Pat. No. 4,449,568 (Narasimham) discloses another system in which an inverted pressure bell is partially immersed in liquid metal in a tundish. By varying the gas pressure in the pressure bell, the level of liquid metal outside the pressure bell (and thus the hydrostatic pressure at the tundish outlet) can be maintained substantially constant.

Both of these known systems teach the use of a pressurised gas acting directly on the molten metal as a means for controlling the flow of molten metal from the tundish. However, the system taught by U.S. Pat. No. 3,384,150 relies upon a combination of pressure applied within the tundish, and maintenance of a substantially constant metal level within the tundish, to ensure constant metal flow rate to the mold. The system disclosed in U.S. Pat. No. 4,449,568 relies exclusively on maintenance of a constant level of molten metal in the tundish to ensure a constant rate of flow therefrom.

In either of the above-mentioned prior art systems, if the level of metal in the tundish is allowed to drop, due, for example, to an interruption of the flow of metal into the tundish, maintenance of a constant flow rate of metal into the casting machine would become difficult or impossible. A further disadvantage of the prior art systems is that operating by means of gas pressure acting directly on the liquid metal necessarily complicates the liquid metal handling system, thereby increasing its cost and the risk of failure. Furthermore (particularly in the case of U.S. Pat. No. 3,384,150), true continuous casting is impossible, because a reservoir of molten metal must be placed in a sealed chamber prior to beginning the casting operation. When the liquid metal in the reservoir is consumed, the casting operation must be interrupted to permit the supply of liquid metal in the reservoir to be replenished.

U.S. Pat. No. 4,471,831 (Ray) discloses a continuous casting machine having a chamber which can be pressurized with an inert gas to prevent oxidation of the finished metal product. In order to control the flow of molten metal from the tundish to the nozzle, Ray teaches the use of a shutter or the like mounted at the nozzle outlet.

The above-noted references (and in particular the patents to Narasimham and Ray) teach the art of casting very thin filaments of metal (i.e. a 15 to 100 micron thick sheet or strip) at high speeds. The dimensions of the nozzle orifices used are several hundred times this product dimension (0.06 to 0.1 inch in Ray), and thus do not directly influence the thickness of the finished product. The use of protective gases (as taught by Ray) is known to be necessary to prevent surface degradation of the thin filament. In the field covered by the above references, and known as Rapid Solidification Technology, it is also known to use pressure above the (small) melt to force liquid through a small (see Ray, for example) orifice to form a pendant drop which is maintained in place by surface tension and thus remains stationary, i.e. there is no flow of liquid. The rotating casting wheel is then elevated into contact with this liquid drop, and drags away a thin liquid film which rapidly freezes ($10^{6\circ}$ C. per second in Narasimham) to become the desired glassy metal filament.

There are situations, however, where it is desired to continuously cast a metal product having product thickness dimensions very much larger than those produced by the devices taught by Ray and Narasimham. In such cases, it is often desired that the product thickness be in the range of 1 mm–100 mm (≈0.03–4.0 inch), requiring a substantial flow rate of metal through the nozzle while maintaining accurate control of such flow rate, and control of the cross-section of the moving liquid stream. In these situations of sheet, strip or plate casting, it is desired to continuously cast a metal product having controlled dimensions which are substantially determined by the internal shape of the nozzle outlet. It is also imperative that the method used to control the metal flow rate must not alter either the dimensions of the nozzle outlet (as would result from the use of a shutter or the like), or the flow stream of liquid metal as it exits the nozzle outlet.

SUMMARY OF THE INVENTION

It is therefore an object of the present invention to provide a method for controlling the flow of liquid metal in a continuous casting machine in which the dimensions of the solidified metal product are substantially determined by those of the nozzle outlet.

It is another object of the present invention to provide a method and apparatus for continuous casting of liquid metals wherein the dimensions of the solidified metal product are substantially determined by those of the nozzle outlet.

According to an aspect of the present invention, there is provided a method of controlling the flow of liquid metal from a tundish and into a continuous casting machine having a nozzle outlet the dimensions of which substantially determine the dimensions of a solidified cast metal product produced by the continuous casting machine, said method comprising the step of controlling the pressure differential between a gas pressure acting on liquid metal in the tundish, and a gas pressure surrounding the nozzle outlet.

According to another aspect of the present invention there is provided an apparatus for controlling the rate of flow of liquid metal from a tundish into a continuous casting machine, the apparatus comprising a nozzle for directing the flow of liquid metal from the tundish and into the continuous casting machine, the nozzle having an outlet the dimensions of which substantially determine the dimensions of a solidified cast metal product produced by the continuous casting machine; and control means for controlling the pressure differential between a gas pressure acting on liquid metal in the tundish, and a gas pressure surrounding the outlet of the nozzle.

Preferably, the tundish is open to the atmosphere, thereby permitting ready access for addition of liquid metal during a casting operation. In this embodiment, the gas pressure acting on the liquid metal in the tundish will be ambient atmospheric pressure, so that control of the gas pressure differential between the tundish and the nozzle outlet is effected by actively controlling the gas pressure within a chamber surrounding the nozzle outlet.

Preferably, the gas pressure in the tundish, the gas pressure surrounding the nozzle outlet, and the level of the liquid metal in the tundish with respect to the nozzle outlet are measured to provide feedback data for a control means. This data can then be used to accurately control the flow velocity of liquid metal as it emerges from the nozzle outlet.

Preferably, the control means includes a pneumatic control unit driven by a control computer. The pneumatic control unit preferably includes pressure sensor ports to which respective pneumatic tubes can be attached, the open end of each tube being located in the region in which the gas pressure is to be detected. The pneumatic control unit then converts the detected gas pressure into an electronic signal which is supplied, as a feedback signal, to a computer. Such an arrangement ensures accurate pressure readings, without exposing sensitive electronic circuits to the extreme conditions present, for example, in the tundish.

The level of liquid metal in the tundish can be measured by any known means appropriate to the temperature regime of the liquid metal (such as, for example, a float connected to a Linear Voltage Differential Transducer (LVDT), or a laser or other optical device, or other known liquid level detection devices employing ultra-sound or electromagnetic or radiation absorption techniques), connected to the control computer, so that the level of liquid metal in the tundish can be detected to a high degree of accuracy.

In a preferred embodiment, the control computer also receives a signal from the speed control of the casting machine, so that the flow rate of liquid metal can be continuously controlled and the flow rate optimized for the casting speed of the machine.

In a further preferable embodiment, gas pressure within the chamber is controlled by means of a valve controlled by the pneumatic controller, whereby opening of the valve releases gas from the chamber, thereby causing a reduction in the gas pressure.

In an alternative embodiment, gas pressure in the chamber is controlled by means of a valve located in the supply line between a source of pressurised gas, and the chamber, whereby opening of the valve increases the flow of pressurised gas to the chamber, thereby causing an increase in gas pressure.

BRIEF DESCRIPTION OF THE DRAWINGS

Embodiments of the invention will now be described in detail by way of example, with reference to the appended drawings, in which:

FIG. 5 shows a table of maximum allowable diameters and heights of circular and rectangular nozzle outlets, respectively, for a variety of liquid metals.

DETAILED DESCRIPTION OF A PREFERRED EMBODIMENT

Figure 1:
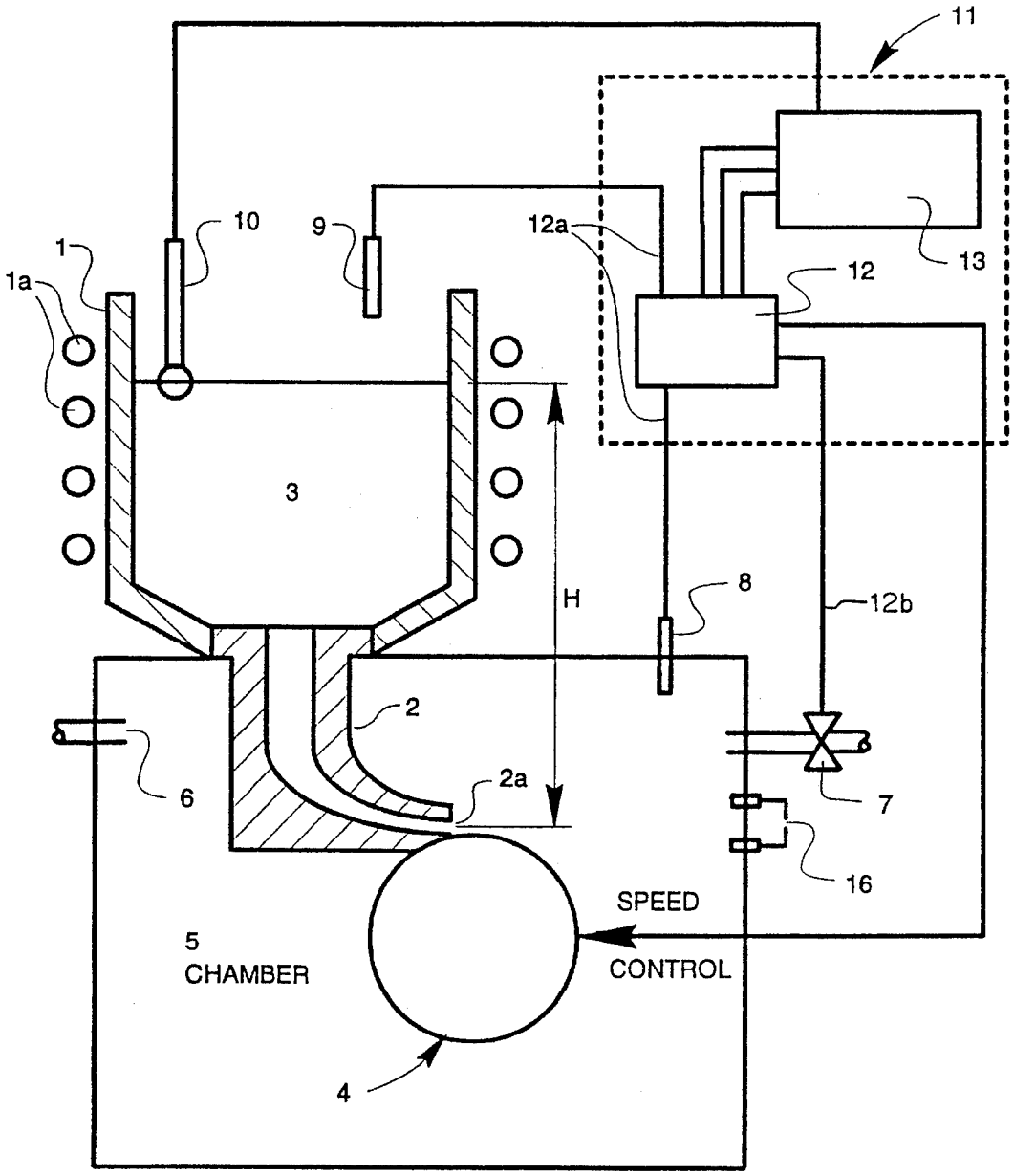
FIG. 1 is a schematic illustration of a continuous casting system according to an embodiment of the present invention

Referring now to FIG. 1, which schematically illustrates a tundish 1 and nozzle 2 containing liquid metal 3, which flows through the nozzle 2 and into a continuous casting machine 4. In the illustrated embodiment, the continuous casting machine 4 is shown as a single-roller strip casting machine. However, it will be understood that the present invention can equally be used with other types of continuous casting machines, such as those employing twin rolls, single or twin belts, or wheel and belt configurations to continuously solidify the supplied liquid metal. In the illustrated embodiment, the outlet 2*a* of the nozzle 2 is oriented so that the liquid metal emerging therefrom flows in a direction substantially tangential to the roller of the casting machine 4. It will be understood that other geometries are workable, the important factor being that the dimensions of the nozzle outlet 2*a* determine the dimensions of the stream of liquid metal emerging therefrom, and thus the dimensions of the cast metal product. Surrounding the continuous casting machine 4 is a chamber 5 having a pressure gas inlet 6 and relief valve 7.

As illustrated in FIG. 1, an induction coil 1*a* may be provided around the tundish 1 to ensure that the liquid metal 3 in the tundish 1 and nozzle 2 does not cool and solidify. A second induction coil (not shown) can be placed around the nozzle 2 to further control heating or superheating of the liquid metal therein.

The chamber 5 is supplied with pressurised gas from a suitable source (not shown) through the pressure gas inlet line 6. In one embodiment of the present invention, the supply of pressure gas is continuous, and the gas pressure in the chamber controlled by means of the relief valve 7. In an alternate embodiment, the supply of pressure gas can be controlled, for example by means of a valve (not shown) in the pressure gas supply line 6. The gas can suitably be selected according to the type of metal in question. For example, for iron and steel, air or nitrogen can advantageously be employed, For highly reactive metals (such as, for example, Ti, Zr and Mg) the gas can be selected to minimize reoxidation of the liquid metal in the vicinity of the nozzle outlet 2*a*.

The chamber 5 further includes one or more pressure seals 16, which facilitates continuous removal of solidified metal from the chamber 5, while minimizing leakage of pressure gas. By this means, solidified metal can be continuously removed from the chamber 5 without disturbing control of the gas pressure $P_1$ within the chamber 5, and therefore the liquid metal flow control characteristics out of the nozzle 2.

A chamber pressure sensor 8 measures the gas pressure $P_1$ within the chamber 5, and thus the gas pressure acting at the outlet 2*a* of the nozzle 2. A tundish pressure sensor 9 measures the gas pressure within (or near) the tundish 1, and thus the gas pressure $P_0$ acting on the liquid metal 3 in the tundish 1. A Linear Voltage Differential Transducer (LVDT) 10, or other suitable level measuring device (not shown), measures the level of liquid metal 3 in the tundish 1, which, in combination with the known geometry of the tundish 1 and nozzle 2, permits determination of the height H of the liquid metal 3 above the outlet 2*a* of the nozzle 2.

Various suitable means can be utilised to implement the chamber and tundish pressure sensors, 8 and 9 respectively. For example, the sensors can comprise conventional pressure-sensitive transducers, which detect the gas pressure directly, and generate corresponding electrical signals. Alternatively, the sensors can include pneumatic tubes which are connected at one end to remote pressure transducers. The open end of the pneumatic tubes are then situated at or near the location at which the gas pressure is to be detected. This alternative arrangement has the advantage that the pressure transducers can be placed at a location remote from the high temperature environment existing near the tundish 1 and the casting machine 4.

Overall control of the system can be provided by means of a process control system 11 generally comprising a controller unit 12 and a computer 13. The controller unit 12, which can be a pneumatic controller, can include pressure reading input ports 12*a* for connection to the chamber and tundish pressure sensors, 8 and 9, as well as control signal output ports 12*b* for controlling the relief valve 7. The pressure reading input ports 12*a* can comprise electronic connections for receiving electrical signals from pressure transducers. Alternatively, the input ports 12*a* can comprise pneumatic inlets connected to pressure transducers within the controller unit. In addition, the controller unit 12 can include data output ports, which facilitate connection to a computer 13, or a recording device (not shown) for data acquisition, thereby facilitating analysis of the operational parameters of the system.

The computer 13 controls the controller unit 12 (according suitable programming) in response to the measured chamber and tundish pressures $P_1$ and $P_0$ respectively, and the level of the liquid metal 3 in the tundish 1 in order to provide the desired velocity of flow at the outlet 2*a* of the nozzle 2. The principle of operation of the system is described in detail in the following paragraphs.

The key element in controlled continuous casting operations of the type envisaged in the present invention is to control the velocity V of the liquid metal 3 at the outlet 2*a* of the nozzle 2. This velocity is given by:

$$V = C_d\sqrt{\frac{2\Delta P}{\rho}} \qquad \text{[eqn. 1]}$$

Where $C_d$ is a discharge coefficient that depends on Reynold's number, nozzle configuration and liquid velocity V. ΔP, which is the pressure of the liquid metal 3 at the outlet 2*a*, is given by:

$$\Delta P = \rho g H + P_0 - P_1 \qquad \text{[eqn. 2]}$$

or (from [eqn. 1]):

$$\Delta P = \frac{\rho}{2}\left(\frac{V}{C_d}\right)^2 \qquad \text{[eqn. 3]}$$

Where $P_0$ is the pressure in the tundish 1, and $P_1$ is the pressure inside the chamber 5. H is the height of the liquid metal 3 in the tundish 1, with respect to the outlet 2*a* of the nozzle 2. ρ and g, of course, represent the density of the liquid metal, and gravitational acceleration, respectively.

Conveniently, $P_0$ is held constant at atmospheric pressure. This means that the pressure differential ($P_1$–$P_0$) between the tundish 1 and the chamber 5, and thus the velocity of flow of liquid metal, can be controlled simply by controlling $P_1$. Accordingly, in the following discussion and examples, $P_0$ will be assumed to a constant, and thus the problem of determining a suitable pressure differential ($P_1$–$P_0$) for a desired liquid metal flow rate will be discussed in terms of determining suitable values of $P_1$. On this basis, $P_1$ can be determined from equations [2] and [3] as follows:

$$P_1 = \rho g H + P_0 - \frac{\rho}{2}\left(\frac{V}{C_d}\right)^2 \qquad \text{[eqn. 4]}$$

For a constant Liquid velocity V and thus a constant ΔP, the pressure $P_1$ is related in a linear manner to the liquid height H. So that:

$$P_1 = \rho g H + C_1 \qquad \text{[eqn. 5]}$$

where $$C_1 = P_0 - \frac{\rho}{2}\left(\frac{V}{C_d}\right)^2$$

is a constant.

For a constant liquid level, H, the pressure $P_1$ can be related to the liquid velocity V as follows:

$$P_1 = -\frac{\rho}{2}\left(\frac{V}{C_d}\right)^2 + C_2 \qquad \text{[eqn. 6]}$$

Where $C_2 = \rho g H + P_0$ is a constant.

Since the pressure $P_0$ in the tundish is assumed constant at atmospheric pressure, the parameter that controls the flow velocity at the nozzle outlet 2*a* is the pressure $P_1$ in the chamber 5 through equation [5] in the case of a variable liquid level, H, and through equation [6] in the case of a constant liquid level.

It will be recognised, of course, that in all of the equations provided in the present specification, all pressures are absolute, with a pressure of 0 being vacuum, and normal atmospheric pressure being ≈0.1 MPa (≈14.5 psi). In order to provide a better understanding of the operation of the present invention, the following two examples are provided.

EXAMPLE 1

Constant Liquid Level in the Tundish

During casting, the liquid level, H, in the tundish is maintained constant by continuously adding additional liquid metal. This operation, of course, can be controlled by the computer 13 on the basis of the liquid metal level indicated by the LVDT 10 (or other suitable liquid level measuring means). Given a constant liquid level in the tundish 1, the velocity V of the liquid metal at the outlet 2*a* of the nozzle 2 is controlled only by the pressure $P_1$ in the chamber, according to equation [6]. For example, the velocity V of liquid steel (density: $\rho$=7200 Kg/m$^3$$\rho$450 lb/ft$^3$), if H=1 m (≈39.4 inches), may be varied in a controlled manner, from 0 m/s (=0 ft/s) to a maximum of 4 m/s (≈13.12 ft/s) by controlling $P_0$=atmospheric pressure and computer controlling $P_1$ in the range 0.17 MPa (≈24.5 psi) to 0.1 MPa (≈14.5 psi).

The pressure $P_1$ inside the chamber is controlled by the valve 7 opening through the controller unit 12 and using the sensors 8 and 9, and the value of $P_1$ in turn controls the velocity V.

While the liquid level in the tundish can be maintained substantially constant, small fluctuations in the liquid level are virtually inevitable. These fluctuations in H can be compensated for by varying $P_1$, using equation [5], to keep the velocity V constant.

EXAMPLE 2

Varying Liquid Level in the Tundish

In a batch process the liquid metal level H decreases continuously during the casting operation. To keep the velocity V of the liquid metal 3 at the outlet 2*a* constant, the pressure $\Delta P$ at the outlet 2*a* must also be kept constant. In this case, the chamber pressure $P_1$ is caused to decrease according to equation 5.

The process control system is used to control the pressure $P_1$ as follows: The LVDT 10 (or other suitable liquid level measuring means) monitors the liquid level in the tundish 1, and the chamber pressure sensor 8 measures the pressure $P_1$ inside the chamber. The liquid level measured by the LVDT 10 (or other suitable liquid level measuring means) is used to calculate (using equation [5]), the required pressure value $P_1$ needed to keep $\Delta P$ constant. The controller unit 12 is then caused to control the valve 7 so that the pressure inside the chamber 5 matches the required value.

Thus, as H decreases during casting, the servo-system progressively reduces $P_1$ to keep V at the required level.

One important feature of the present invention is that the flow velocity of liquid metal does not depend on the shape of the nozzle outlet 2*a*. In the case of a circular outlet, there is a maximum diameter below which the fluid flow can be controlled pneumatically by the method according to the invention. In the case of a nozzle with a rectangular section, the condition of maximum outlet dimension applies only to the height with no limit to the nozzle width. This maximum dimension depends on the surface tension and the density of liquid metal.

Figure 2:
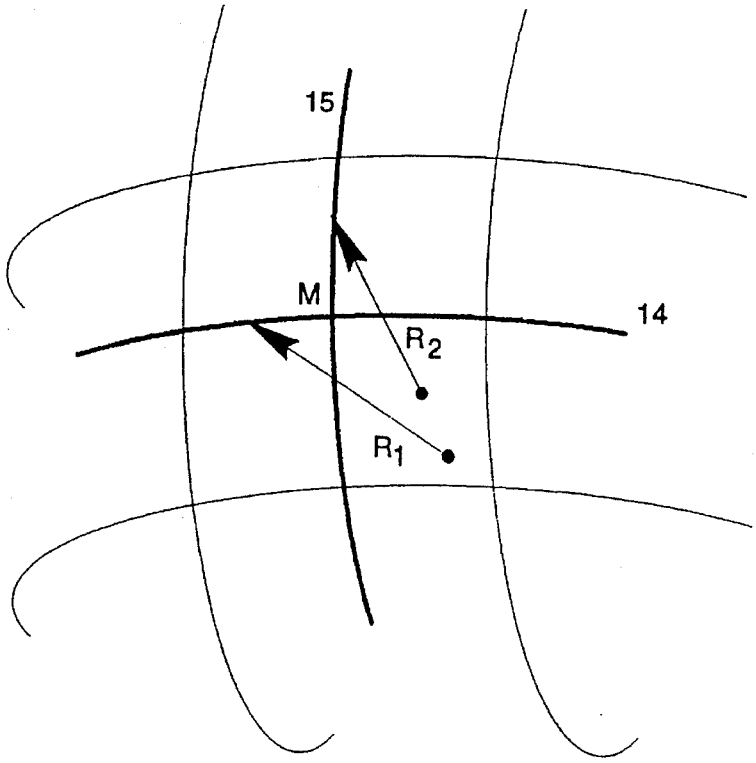
FIG. 2 is a schematic representation showing the notation used to analyze the curvature of a general surface of separation between two fluid media.

In general, if two media, here liquid metal and gas, are separated by curved surface, as shown schematically in FIG. 2, the pressures near it in the two media are different. If the two media are in thermodynamic equilibrium together, the pressure difference (called surface pressure) is given by the following relation:

$$P_1 - P_2 = \sigma\left(\frac{1}{R_1} + \frac{1}{R_2}\right) \quad \text{[eqn. 7]}$$

where $\sigma$ is the surface tension of liquid metal, $R_1$ and $R_2$ are the principal radii of curvature at a given point of the surface of the liquid metal and $P_1$ and $P_2$ are the pressures in the two media.

Special Case 1: Nozzle having a circular outlet

When the outlet of the nozzle is circular, the shape of the surface of separation of liquid metal and the gas is (ideally) spherical with a radius $R=R_1=R_2$. R is also the radius of the circular section of the nozzle.

Figure 3:
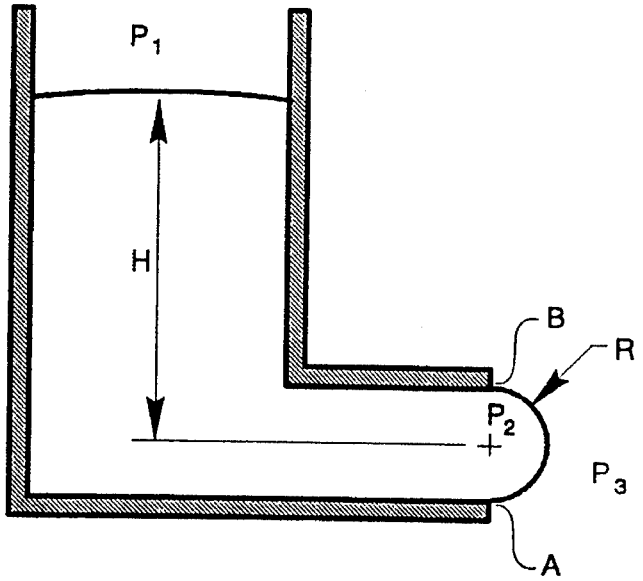
FIG. 3 is a schematic illustration showing the notation used to analyze a surface of separation in the case of a nozzle having a circular outlet.

Referring to FIG. 3, H is the height of the liquid metal under pressure $P_1$. $P_2$ is the hydrostatic pressure inside the metal at the nozzle. $P_3$ is the pressure at the metal/gas interface at the nozzle exit. Thus:

$$P_2 = P_1 + \rho g H \quad \text{[eqn. 8]}$$

$$P_2 - P_3 = \sigma\left(\frac{1}{R_1} + \frac{1}{R_2}\right) \quad \text{[eqn. 9]}$$

$$P_2 - P_3 = 2\frac{\sigma}{R} \quad \text{[eqn. 10]}$$

where:

$\sigma$ is the surface tension of liquid metal; $R_1$ and $R_2$ are the principal radii of curvature at a given point of the surface of the liquid at the exit of the nozzle, which in the present case is spherical in shape with $R_1=R_2=R$.

The presence of the pressure gradient from B to A, if it is small, can be equilibrated by the liquid surface tension and a small adjustment in the shape of the liquid surface at the nozzle exit. The shape of the free surface of the liquid at the nozzle exit is assumed (for the purposes of analysis) to be a perfect half sphere. Under equilibrium conditions at points A and B the absolute value of the variation of the pressure is equal to:

$$|P_2 - P_3| = \rho g R \quad \text{[eqn. 11]}$$

Combining equations [10] and [11], R can be subtracted as follows:

$$R_{max} = \sqrt{\frac{2\sigma}{\rho g}} \quad \text{[eqn. 12]}$$

where $R_{max}$ represents the maximum radius of a circular section of cylindrical nozzle that can allow the flow to be controlled pneumatically by the method of the present invention. If R is higher than $R_{max}$, the hydrostatic pressure gradient from B to A will be too high to equilibrate.

Special Case 2: Nozzle having a rectangular outlet

Figure 4A:
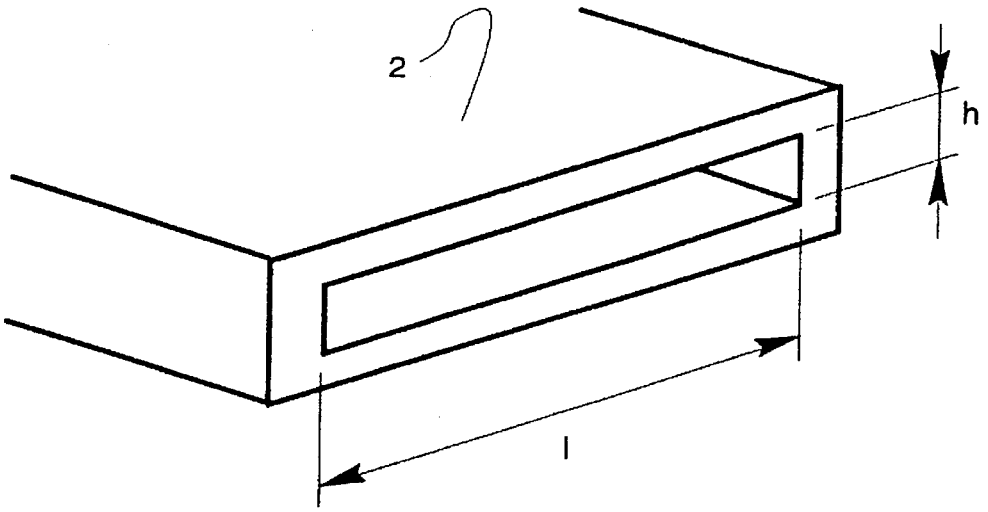
FIGS. 4*a* and 4*b* are schematic representations showing the notation used to analyze a surface of separation in the case of a nozzle having a rectangular outlet.
Figure 4B:
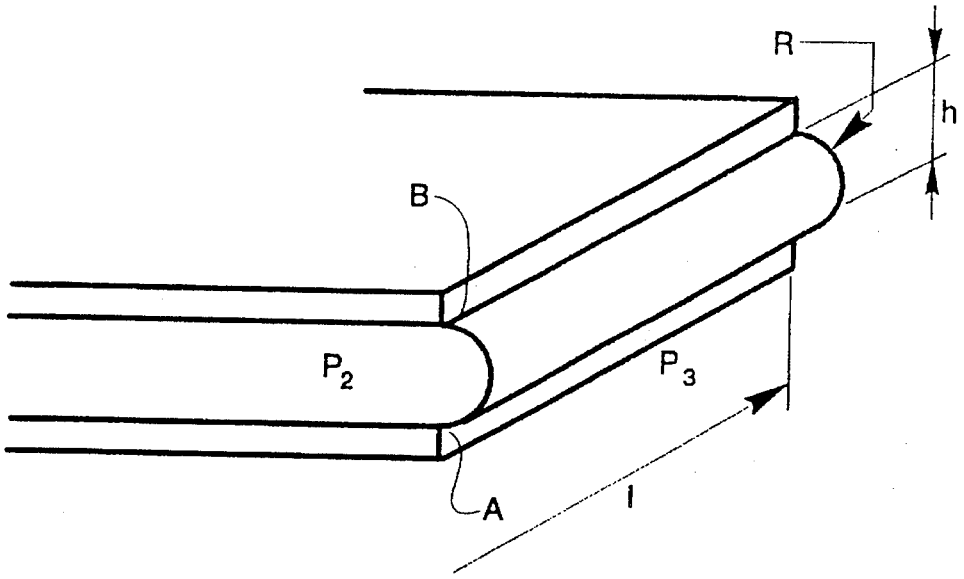

When the outlet of the nozzle is rectangular, the shape of the surface of separation of the liquid metal and the gas is cylindrical with radius $R_1=h/2$, and $R_2=\infty$ Referring to FIGS. 4*a* and 4*b*, h is the height of the nozzle outlet and l is its width. In this case:

$$P_2 - P_3 = 2\frac{\sigma}{h} \quad \text{[eqn. 13]}$$

As in the previous case, under equilibrium conditions, the value of $|P_2-P_3|$ is equal to:

$$|P_2 - P_3| = \frac{\rho g h}{2} \quad \text{[eqn. 14]}$$

From equations [13] and [14] the maximum height of the nozzle that can permit the flow to be pneumatically controlled is:

$$h_{max}=2\sqrt{\frac{\sigma}{\rho g}} \quad \text{[eqn. 15]}$$

There is no limit on the width, the nozzle can be as wide as required for production, except for mechanical limitations, particularly with respect to rectilinarity of the nozzle opening at higher values of 1. If h exceeds $h_{max}$, the hydrostatic pressure gradient through the nozzle opening thickness will be too high to equilibrate.

The maximum radius, and thus diameter, of the circular nozzle outlet section and the maximum height of the rectangular nozzle outlet section depend only on the surface tension and the density of the liquid metal.

The table in FIG. 5 illustrates values of the maximum diameters and heights of nozzles with circular and rectangular outlets, respectively, for some liquid metals. In an industrial application, the presence of an adhering oxide film on the liquid metal surface at nozzle exit may effectively increase the maxima shown in FIG. 5.

It will be apparent to those skilled in the art that there are a variety of ways in which the features of the invention can be implemented without departing from the scope of the invention.

For example, the chamber 5 has been described a surrounding the continuous casting machine 4. However, it will be apparent that the chamber 5 could equally be constructed so as to enclose a comparatively small volume surrounding the outlet 2*a* of the nozzle 2. In this case suitable sealing means could be provided to minimize leakage of pressure gas from the chamber 5, between the walls of the chamber 5 and the casting machine 4 and solidified metal downstream of the outlet 2*a*. The advantage, in this case, is that by minimizing the volume of the chamber 5, the volume of pressure gas required by the system is reduced. Additionally, because a lower volume of gas is involved, pressure changes in the chamber 5 can be effected more rapidly, and thus the responsiveness of the control system is increased.

Furthermore, a filter can be installed inside the nozzle to eliminate turbulence and induce laminar fluid flow. Installation of a filter also allows the cleanliness of liquid metal to be improved by retaining oxide inclusions.

Still further, in the preceding discussion of a preferred embodiment, the gas pressure $P_0$ in the tundish was assumed to be constant at atmospheric pressure, and control of the liquid metal was effected by controlling $P_1$ in the chamber 5. This is convenient, because it allows the tundish to be open to the atmosphere, which obviously facilitates addition of new liquid metal to the tundish during a continuous casting operation. However, it will be recognised that there are other ways of achieving the required pressure differential ($P_1-P_0$) to control the liquid metal flow.

For example, instead of a chamber 5 surrounding the continuous casting machine, and connected to a source of pressurized gas, a chamber could be provided surrounding the tundish and connected to a suitable source of vacuum. In this case, $P_1$ is held constant at atmospheric pressure, and the flow of liquid metal is controlled by controlling $P_0$.

Alternatively, two chambers could be used: a first chamber 5 surrounding the continuous casting machine, and connected to a source of pressurized gas as illustrated in FIG. 1, and a second chamber surrounding the tundish and connected to a suitable source of vacuum. In this case, the flow of liquid metal would be controlled by simultaneously controlling both $P_1$ and $P_0$.

We claim:

1. A method of controlling the flow of liquid metal from a tundish and into a continuous casting machine having a nozzle outlet the cross-sectional dimensions of which substantially determine the transverse cross-sectional dimensions of a solidified cast metal product produced by the continuous casting machine, said method comprising the steps of providing the casting machine, injecting said liquid metal through said nozzle directly onto said casting machine and of controlling the pressure differential between a gas pressure acting on liquid metal in the tundish, and a gas pressure surrounding the nozzle outlet.

2. A method as claimed in claim 1, further comprising the steps of:

sensing a gas pressure acting on liquid metal in the tundish;

sensing the level of liquid metal in the tundish;

sensing a gas pressure acting on the liquid metal at an outlet of the nozzle; and controlling the gas pressure acting on the liquid metal at the outlet of the nozzle in response to the measured height of liquid metal in the tundish with respect to the outlet of the nozzle, and the gas pressure acting on the metal in the tundish, whereby the velocity of flow of liquid metal from said tundish into said continuous casting machine through said nozzle is controlled by varying the gas pressure acting on the liquid metal at the outlet of the nozzle.

3. A method as claimed in claim 1, wherein, for a constant velocity of flow of liquid metal from the outlet of the nozzle, the gas pressure acting on the liquid metal at the outlet of the nozzle is controlled according to the equation:

$$P_1=\rho g H+C_1$$

wherein:

$P_1$ is the gas pressure acting on the liquid metal at the outlet of the nozzle;

H is the measured height of liquid metal in the tundish with respect to the outlet of the nozzle; and $C_1$ is a constant.

4. A method as claimed in claim 1, wherein, for a constant height of liquid metal in the tundish, the gas pressure acting on the liquid metal at the outlet of the nozzle is controlled according to the equation:

$$P_1=-\frac{\rho}{2}\left(\frac{V}{C_d}\right)^2+C_2$$

wherein:

V is a desired flow velocity of liquid metal at the outlet of the nozzle;

$P_1$ is the gas pressure acting on the liquid metal at the outlet of the nozzle;

$C_d$ is a discharge coefficient that depends on Reynold's number, nozzle configuration and liquid velocity; and $C_2$ is a constant.

* * * * *

UNITED STATES PATENT AND TRADEMARK OFFICE

CERTIFICATE OF CORRECTION

PATENT NO. 5,515,906

DATED May 14, 1996

INVENTOR(S) Robert Thomson, Elhachmi Essadiqu and James Barry

It is certified that error appears in the above-indentified patent and that said Letters Patent is hereby corrected as shown below:

On title page, item [75] should read;

[75] Inventors: Robert Thomson, Ottawa; Elhachmi Es-Sadiqui, Aylmer; James Barry, Nepean, all of Canada Col. 7, line 14: should read:

liquid steel (density: $\rho$ =7200 Kg/m$^3$ ≈ 450 lb/ft$^3$), if H=1m

Signed and Sealed this

Nineteenth Day of November, 1996

*Attest:*

*Attesting Officer*

BRUCE LEHMAN

*Commissioner of Patents and Trademarks*